US007639978B2

(12) United States Patent
Fujisawa

(10) Patent No.: US 7,639,978 B2
(45) Date of Patent: Dec. 29, 2009

(54) BELT NIP TYPE FIXING DEVICE FOR IMAGE FORMING APPARATUS THAT VARIES A WINDING AMOUNT OF A BELT AROUND A HEATING ROLLER

(75) Inventor: Kazutoshi Fujisawa, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 511 days.

(21) Appl. No.: 11/424,515

(22) Filed: Jun. 15, 2006

(65) Prior Publication Data

US 2006/0285891 A1 Dec. 21, 2006

(30) Foreign Application Priority Data

Jun. 15, 2005 (JP) ..... 2005-174650
Jun. 15, 2005 (JP) ..... 2005-174651

(51) Int. Cl.
*G03G 15/20* (2006.01)

(52) U.S. Cl. ..... 399/329; 399/328

(58) Field of Classification Search ..... 399/328, 399/329
See application file for complete search history.

(56) References Cited

U.S. PATENT DOCUMENTS

2005/0220466 A1* 10/2005 Takahashi et al. ..... 399/329

FOREIGN PATENT DOCUMENTS

JP 05-150679 6/1993

* cited by examiner

*Primary Examiner*—David M Gray
*Assistant Examiner*—Ryan D Walsh
(74) *Attorney, Agent, or Firm*—Hogan & Hartson LLP

(57) ABSTRACT

A fixing device including: a heating roller; a pressurizing roller, pressed against the heating roller; a belt extension member, arranged on an upstream side of a medium delivery direction with respect to the pressurizing roller; a belt, wound around outer peripheries of the pressurizing roller and the belt extension member, and moving while forming a fixing nip portion between the heating roller and the belt; and a member, moving the belt extension member rotationally to vary a winding amount of the belt around the heating roller.

7 Claims, 10 Drawing Sheets

BELT NIP TYPE FIXING DEVICE FOR IMAGE FORMING APPARATUS THAT VARIES A WINDING AMOUNT OF A BELT AROUND A HEATING ROLLER

BACKGROUND OF THE INVENTION

1. Technical Field of the Invention

The present invention relates to a fixing device including a heating roller, a pressurizing roller to be pressed against the heating roller, a belt wound around the outer periphery of the pressurizing roller and movable while it is held by and between the pressuring roller and heating roller, and a belt extension member for extending the belt thereon, thereby fixing an unfixed toner image formed on a transfer member, and an image forming apparatus incorporating such fixing device therein.

2. Description of the Related Art

Conventionally, in an image forming apparatus such as a facsimile, there is developed a so called heating roller type fixing device for contact heating and fixing an unfixed image formed on record paper, especially, a belt nip type fixing device which is composed of a heating roller and a belt pressure contact unit.

Now, description will be given below of a conventional belt nip type fixing device with reference to FIG. 1. In FIG. 1, a heating roller 100 is structured such that a hollow roller 101 is covered with HTV silicone rubber as a base layer 102 thereof and silicone RTV rubber is dip coated on the surface thereof as a top coat layer 103, whereby the surface of the heating roller 100 is finished in a state substantially similar to a mirror surface state. In the interior of the heating roller 100, as a heating source, there is disposed a halogen lamp 104. An endless belt 105 made of polyimide resin is extended with a given tensile force on and by three rollers each made of stainless steel, that is, a pressurizing roller 116, a support roller 117 and a support roller 118. The pressurizing roller 116 is energized toward the center of the heating roller 100 by a compression coil spring 109 serving as pressurizing means to thereby press the endless belt 105 against the heating roller 100. The pressurizing roller 116 can driven and rotated by a motor 110, whereas the support rollers 117 and 118 can be rotated following the pressurizing roller 116. A pressure auxiliary roller 111 is disposed on the inside of the portion of the endless belt 105 existing between the pressurizing roller 116 and support roller 117, and a pressing force is applied to the endless belt 105 using the pressure auxiliary roller 111, thereby controlling the tensile force of the endless belt 105 (See, for example, Japanese Patent 3084692, hereinafter referred to as JP'690).

In the fixing device disclosed in the above-mentioned JP'690, since the pressure auxiliary roller for controlling the tensile force of the endless belt is arranged on the inside of the endless belt, the space inside the endless belt must be formed wide. Also, because the positions of the pressurizing roller and support rollers are fixed, the amount of winding of the endless belt around the heating roller cannot be varied.

Therefore, it is necessary to increase the number of support rollers on which the endless belt is provided and, as a result of this, there arises a problem that the peripheral length of the endless belt must be increased. The increased number of support rollers and the increased peripheral length of the endless belt give rise to an increase in the size of the fixing device. Also, because of the increased peripheral length of the endless belt, when the endless belt heated in a nip portion thereof existing between the heating roller and itself moves along a given path, the temperature of the endless belt decreases due to the long peripheral length thereof. This results in an increase in a warming time which is necessary for the temperature of the fixing device to reach a desired temperature after the power supply is turned on, that is, a fixing executable temperature. Further, it is has been also found a fact that, besides the tensile force of the endless belt, the amount of winding of the endless belt on the heating roller provides a great element of the desired fixing performance of the fixing device according to various kinds of paper.

SUMMARY OF THE INVENTION

The present invention aims at eliminating the above problems found in the conventional fixing device and thus it is an object of the invention to provide a belt nip type fixing device which is simple in structure, is capable of controlling the amount of mounting of a belt according to the kind of paper and can be reduced in size, and an image forming apparatus incorporating such fixing device therein.

The above object is attained by the following embodiments.

(1) A fixing device comprising:

a heating roller;

a pressurizing roller, pressed against the heating roller;

a belt extension member, arranged on an upstream side of a medium delivery direction with respect to the pressurizing roller;

a belt, wound around outer peripheries of the pressurizing roller and the belt extension member, and moving while forming a fixing nip portion between the heating roller and the belt; and a member, moving the belt extension member rotationally to vary a winding amount of the belt around the heating roller.

(2). The fixing device according to (1), wherein the member includes a support frame supporting the pressurizing belt and the belt extension member.

(3). The fixing device according to (2), wherein the support frame rotates about a center shaft of the pressurizing roller.

(4). The fixing device according to (3), wherein the member further includes an elastic member biasing the support frame in an opposite direction to the heating roller.

(5). The fixing device according to (4), wherein the member further includes a lever moving the support frame toward the heating roller.

(6). The fixing device according to (1), wherein an amount of rotation of the belt extension member is varied based on the kind of paper.

(7). The fixing device according to (2), wherein a rotation and positioning of the belt extension member are set depending on a rotation and positioning of the support frame.

(8). The fixing device according to (1), further comprising a flexure preventing member interposed between the pressurizing roller and belt extension member.

(9). An image forming apparatus comprising the fixing device according to (1).

According to the above embodiments of the invention, there is provided a fixing device which comprises a heating roller, a pressurizing roller to be pressed against the heating roller, a belt extension member to be arranged on the upstream side of a paper delivery direction with respect to the pressurizing roller, a movable belt wound around the outer peripheries of the pressurizing roller and belt extension member and including a fixing nip portion between the heating roller and itself, and means for rotating the belt extension member in order to vary the amount of winding of the belt around the heating roller. Thanks to this structure, in a postcard, a transparent sheet, a label, an envelope and the like, the occurrences of curling and creases can be prevented. Also, when removing jammed sheets, by decreasing the amount of winding of the belt, the jammed sheets can be removed easily.

Since the pressurizing roller and belt extension member are mounted on the support frame, the control of the winding amount of the belt can facilitated by rotating the belt extension member.

Because use of the structure capable of varying the amount of rotation of the belt extension member according to the kind of paper makes it possible to select the winding amount of the belt according to the kind of paper, there can be provided a fixing device which is free from the curling and creases.

Since the rotation and positioning of the belt extension member are carried out depending on the rotation and positioning of the support frame, the belt winding amount can be controlled easily by rotating the belt extension member.

Because the flexure preventing member is interposed between the pressurizing roller and belt extension member, the flexure of the belt extension member in the axial direction thereof can be reduced without using a metal roller having a large diameter as the belt extension member and thus the belt extension member can be made of resin which is weak in rigidity. Therefore, not only the warm-up time can be shortened and the responsibility of the temperature control can be enhanced, but also the size of the fixing device can be reduced and an image of high quality can be obtained.

When an image forming apparatus incorporates therein a fixing device according to the invention, there can be provided an image forming apparatus which not only can be reduced in size but also can provide a high-quality image.

The above object is also attained by the following embodiments.

(10). A fixing device comprising:

a heating roller;

a pressurizing roller, pressed against the heating roller;

a belt extension member, arranged on an upstream side of a medium delivery direction with respect to the pressurizing roller;

a belt, wound around outer peripheries of the pressurizing roller and the belt extension member, and moving while forming a fixing nip portion between the heating roller and the belt; and a tension roller, arranged between the belt extension member and the pressurizing roller to be brought into contact with the belt from outside of the belt.

(11). The fixing device according to (10), wherein the pressurizing roller and the belt extension member are fixed in position.

(12). The fixing device according to (10), wherein a contact position of the tension roller is varied based on the kind of paper.

(13). The fixing device according to (10), further comprising a flexure preventing member interposed between the pressurizing roller and belt extension member.

(14). An image forming apparatus comprising the fixing device according to (10).

Also, according to the above embodiments of the invention, there is provided a fixing device, comprising: a heating roller; a pressurizing roller to be pressed against the heating roller; a belt extension member arranged on the upstream side of a paper delivery direction with respect to the pressurizing roller; a movable belt wound around the outer peripheries of the pressurizing roller and belt extension member and including a fixing nip portion between the heating roller and itself; and, a tension roller arranged in contact with the outside of the belt between the belt extension member and pressurizing roller. Thanks to this structure, the tensile force of the belt can be controlled without increasing the peripheral length of the belt, the fixing device can be made compact and the warming time can be shortened.

Use of the structure for fixing the positions of the pressurizing roller and belt extension member can facilitate the control of the belt tensile force by the tension roller.

Since the position of the tension roller can be varied according to the kind of paper, the tensile force of the belt can be controlled simply and thus the occurrence of creases and curling of paper due to the different thicknesses and rigidity of the paper can be prevented, which can prevent the lowered fixability of the paper.

Because the flexure preventing member is interposed between the pressurizing roller and belt extension member, the flexure of the belt extension member in the axial direction thereof can be reduced without using a metal roller having a large diameter as the belt extension member, the belt extension member can be formed of resin having low rigidity, the warm-up time can be shortened, the responsibility of the temperature control can be enhanced, the fixing device can be reduced in size, and a high-quality image can be obtained.

When a fixing device according to the invention is incorporated into an image forming apparatus, there can be provided an image forming apparatus which not only can be reduced in size but also can provide an image of high quality.

DETAILED DESCRIPTION OF THE INVENTION

Figure 1:
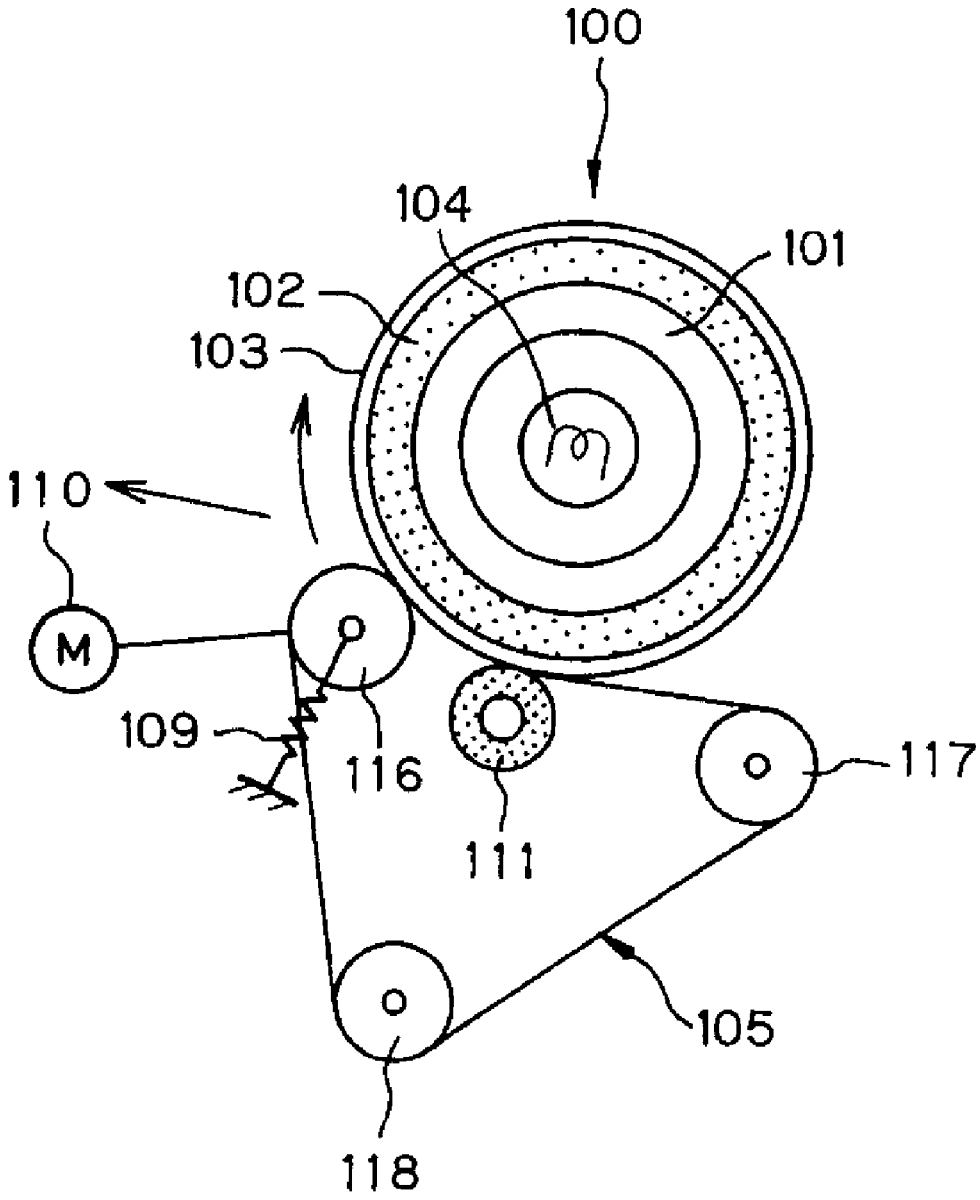
FIG. 1 PRIOR ART
FIG. 1 is a section view of a conventional fixing device.
Figure 2:
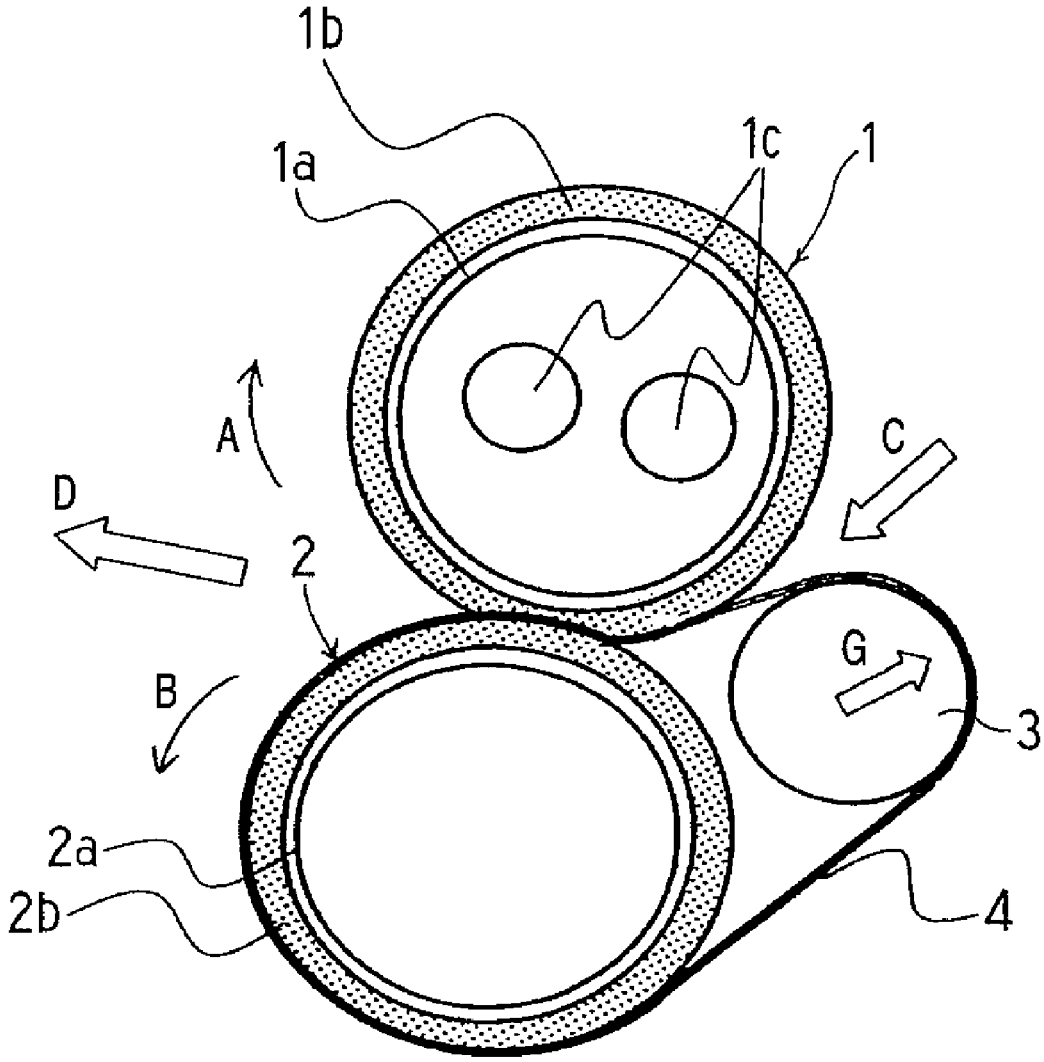
FIG. 2 is an explanatory view of a first embodiment of a fixing device according to the invention.

Now, description will be given below of embodiments of a fixing device and an image forming apparatus according to the invention with reference to the accompanying drawings. FIG. 2 is a typical section view of a first embodiment of a fixing device according to the invention.

The fixing device according to the first embodiment comprises a heating roller 1, a pressurizing roller 2 to be pressed against the heating roller 1, a belt extension member 3 disposed on the upstream side of the delivery direction of a transfer member with respect to the pressurizing roller 2, and a belt 4 which is wound around the outer peripheries of the pressurizing roller 2 and belt extension member 3, includes a fixing nip portion existing between the heating roller 1 and itself, and can be moved.

The heating roller 1 has a diameter of 24 mm or so, is composed of a pipe-shaped core metal 1*a* and an elastic layer 1*b* applied to the outer periphery of the core metal 1*a* so as to cover the same, incorporates therein heating sources 1*c* such as halogen lamps in the interior of the core metal 1*a,* and can be rotated in the A direction shown in FIG. 2.

The pressurizing roller 2 has a diameter of 24 mm or so, is composed of a pipe-shaped core metal 2*a* and an elastic layer 2*b* applied to the outer periphery of the core metal 2*a* so as to cover the same, is disposed opposite the heating roller 1, and can be rotated while it is pressed against the heating roller 1 with a given pressure.

The belt extension member 3 is formed of a resin-made pipe having a diameter of 10 mm or so, cooperates together with the pressurizing roller 2 in applying a tensile force to a belt 4, and is disposed at a position where the belt 4 is wound around the heating roller 1 to thereby form a nip portion. Since the belt extension member 3 is a belt sliding member, it may have a roller-like shape or a half-moon-like shape. A transfer member such as paper enters from the C direction and is discharged to the D direction. Because a tensile force is applied to the belt extension member 3 in the arrow mark G direction with respect to the pressurizing roller 2, the tensile force is applied to the belt 4 and the pressurizing roller 2 is rotated in the B direction, there is generated a pressing force in the belt extension member 3 which is to be applied to the heating roller 1.

Figure 3:
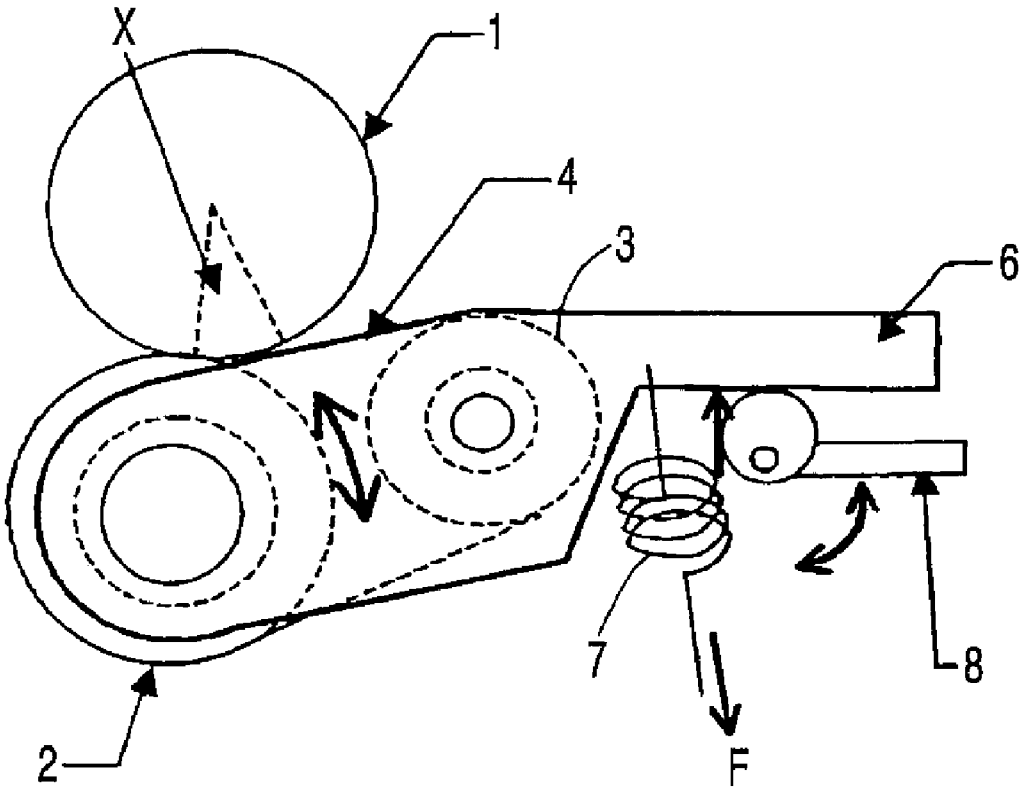
FIG. 3 is an explanatory view of the first embodiment of a fixing device according to the invention.
Figure 4:
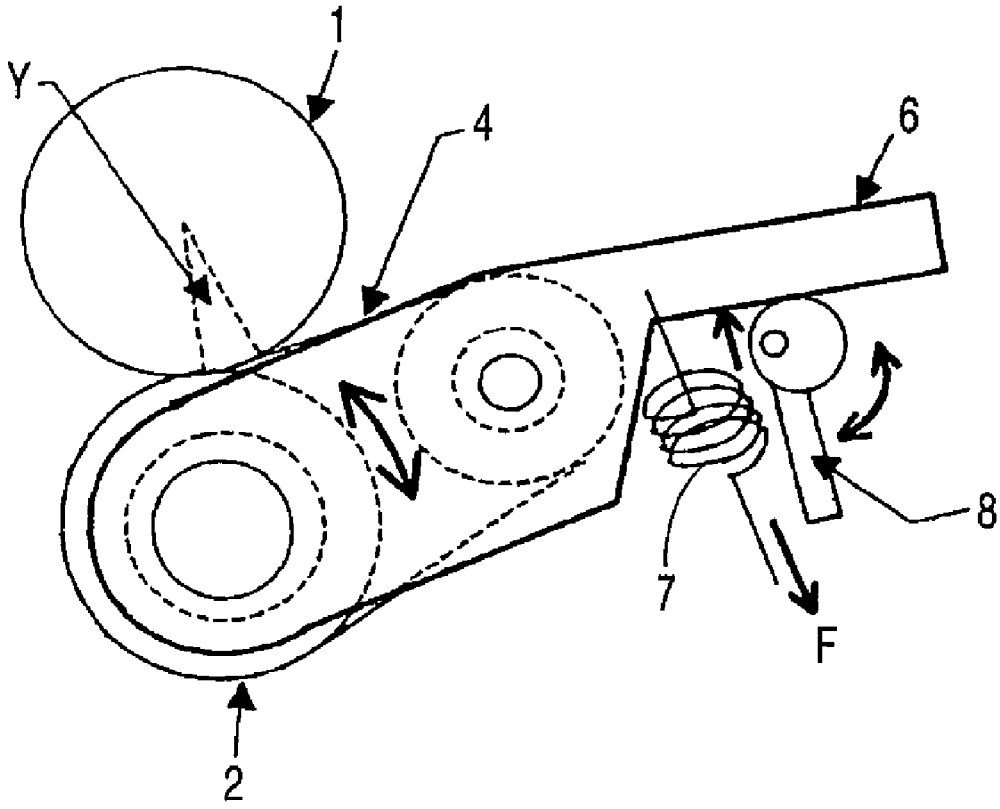
FIG. 4 is an explanatory view of the first embodiment of a fixing device according to the invention.

As shown in FIGS. 3 and 4, the pressurizing roller 2 and belt extension member 3 are disposed in such a manner that the positions thereof are fixed by a support frame 6. The support frame 6 can be rotated about the center shaft of the pressurizing roller 2 as its shaft. The support frame 6 is energized in the arrow mark F direction by a spring 7. A cam type change lever 8 is rotatably in contact with the support frame 6. Here, FIG. 3 shows the state of the winding amount X of the belt 4 in the case of normal paper. And, FIG. 4 shows a state in which, when there is a fear that a postcard, a transparent sheet, a label, an envelope and the like can be curled or creased, by operating and rotating the change lever 8, the support frame 6 is rotated to thereby reduce the winding amount Y of the belt 4.

Figure 5:
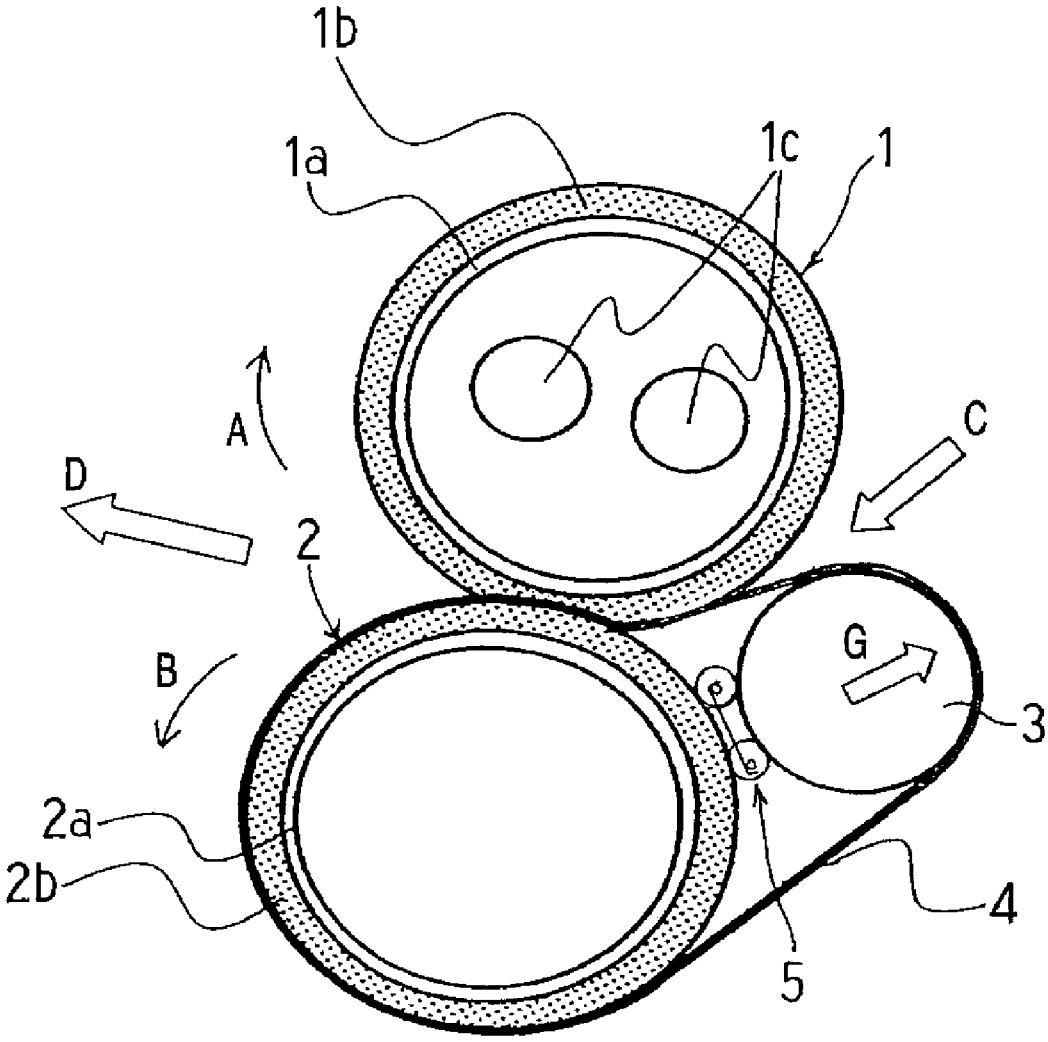
FIG. 5 is an explanatory view of a second embodiment of a fixing device according to the invention.

Now, FIG. 5 shows a second embodiment of a fixing device according to the invention. The present embodiment is different from the embodiment shown in FIG. 2 in that a flexure preventing member 5 is interposed between the pressurizing roller 2 and belt extension member 3. When the belt 4 is mounted on the pressurizing roller 2 and belt extension member 3 with a given tensile force, in some cases, the belt extension member 3 can be flexed due to the tensile force. In view of this, generally, as the belt extension member 3, there is employed a metal roller having a diameter providing small flexure in the axial direction thereof, and the tensile force is applied in the two end portions of the metal roller. However, employment of the metal roller having such diameter increases the heat capacity of the belt extension member, increases the warm-up time thereof and decreases the responsibility thereof to the temperature control. There is also raised another problem that the fixing device increases in size and the radiation amount thereof increases to thereby make it difficult to save energy. Further, when the belt extension member is formed of a roller having a small diameter or is made of resin, the belt extension member can be flexed due to the tensile force of the belt; and, therefore, when paper enters from the belt extension member side, an image formed thereon can be out of position in the central portion of the paper in the width direction thereof.

When, between the pressurizing roller 2 and belt extension member 3, there is disposed the flexure preventing member 5 in the axial-direction central portion of the belt extension member 3, the flexure of the belt extension member due to the belt tensile force can be prevented, and the belt extension member 3 can be formed of a resin-made belt extension member having a small diameter to thereby be able to reduce the size of the fixing device. In this case, since the central portion of the belt extension member 3 flexes, the flexure preventing member 5 is arranged in the central portion of the belt extension member 3 so as to be in contact with the pressurizing roller 2 and belt extension member 3, which makes it possible to shorten the warm-up time.

Figure 6:
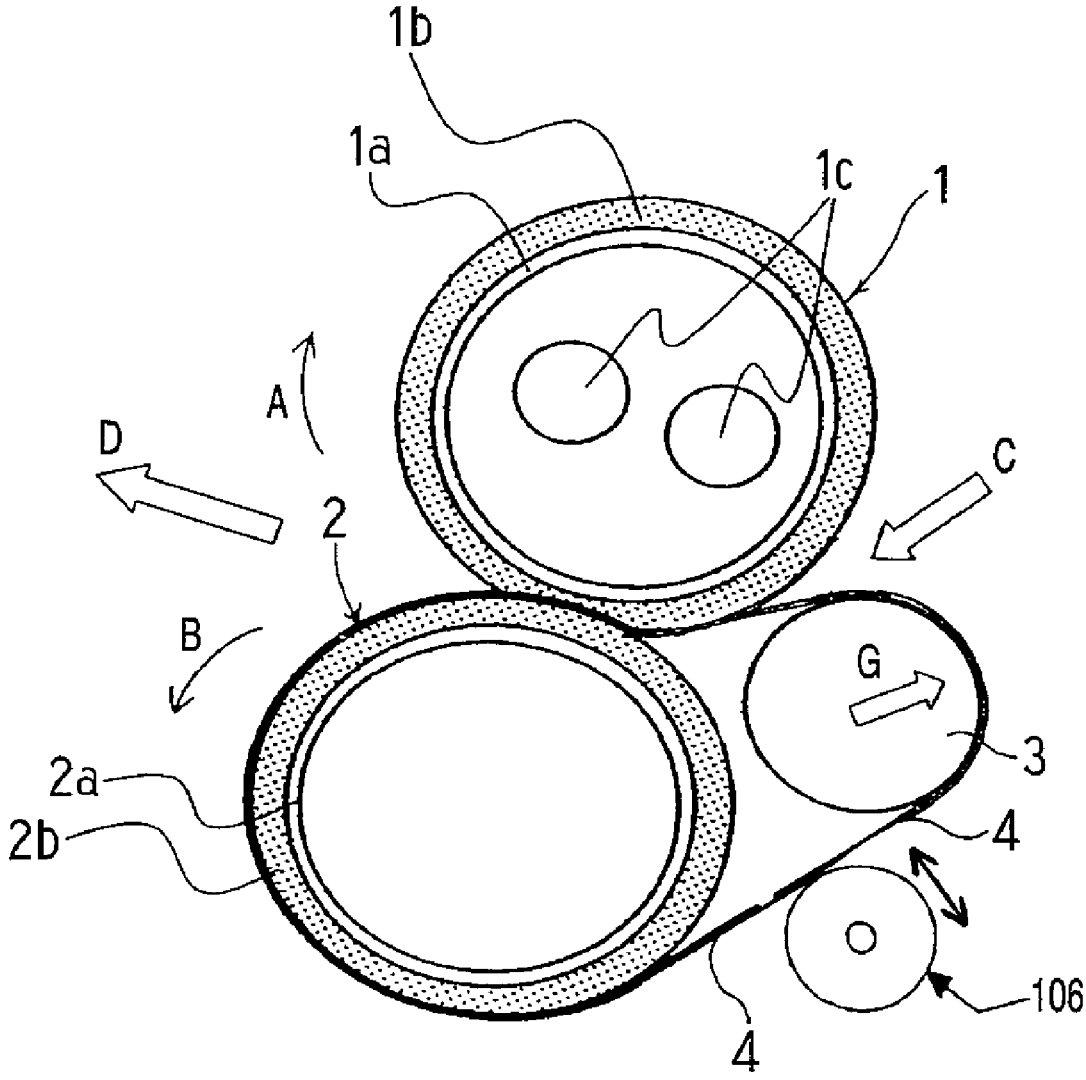
FIG. 6 is an explanatory view of a third embodiment of a fixing device according to the invention.

Now, FIG. 6 is an explanatory view of a third embodiment of a fixing device according to the invention.

The present embodiment is different from the first embodiment in that, instead of the support frame 6, there is interposed a tension roller 106 so as to be in contact with the outer peripheral position of the belt 4 between the pressurizing roller 2 and belt extension member 3. The tension roller 106 has a diameter of 12 mm or so and can be formed by applying an elastic layer over the outer periphery of a core metal. The tension roller 106 is disposed in such a manner that its contact position with the belt 4 can be varied at least two or more stages by moving means.

When fixing is executed under the condition that the tensile force of the belt 4 is constant at a normal speed, for thin paper, the fixability of the paper is high but the paper is influenced easily by the nip pressure of the fixing to thereby increase the possibility that the paper can be creased or curled greatly. On the other hand, for rather thick paper, because of its high rigidity, such creases and curl are hard to occur. However, owing to its large heat capacity, the temperature of the paper is difficult to rise and thus, when the nip pressure is weak, the fixability of the paper can be lowered.

In view of the above, according to the invention, the belt tensile force is controlled in such a manner that the contact position of the tension roller 106 with the belt 4 can be varied in the outer peripheral position of the belt 4. For rather thin paper, the tensile force of the belt 4 is decreased to thereby prevent an increase in the occurrence of creases and curl; and, for rather thick paper, the tensile force of the belt 4 is increased to thereby secure the fixability of the paper.

When the tensile force of the belt 4 is decreased, the pressing load of the tension roller 106 against the belt 4 is 1.6 kgf and the tensile force of the belt 4 is 2.5 kgf. When increasing the tensile force of the belt 4, the pressing load of the tension roller 106 against the belt 4 is 4.0 kgf and the tensile force of the belt 4 is 5 kgf.

Figure 7:
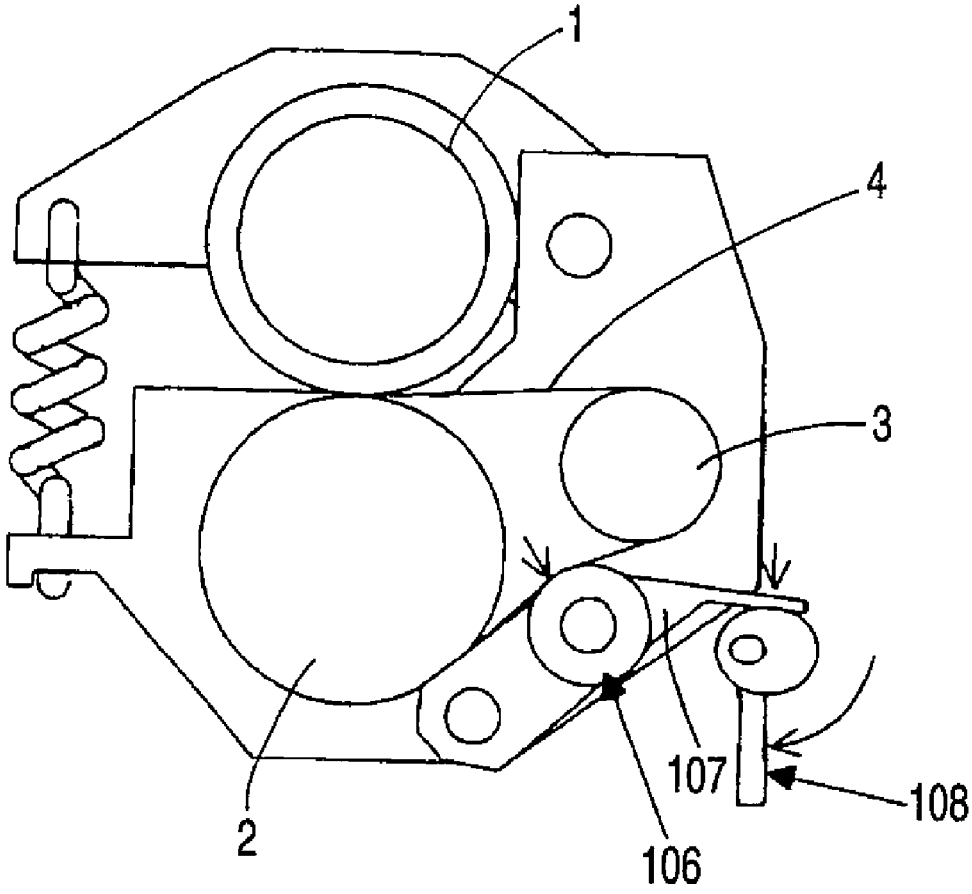
FIG. 7 is an explanatory view of an embodiment of moving means for moving a tension roller, showing a state for thin paper.
Figure 8:
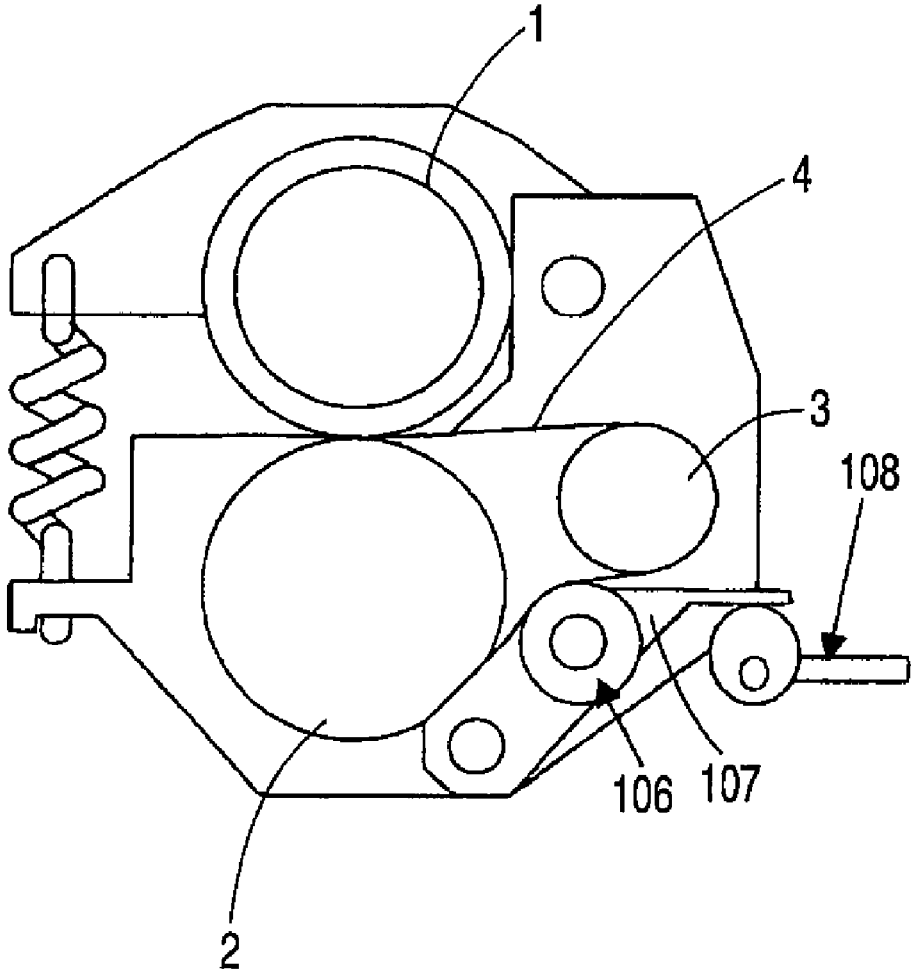
FIG. 8 is an explanatory view of the above embodiment of moving means for moving a tension roller, showing a state for thick paper.

Now, FIGS. 7 and 8 show an embodiment of the moving means for moving the tension roller 106. A frame 107, which holds the tension roller 106, is arranged such that it can be rotated. And, there is disposed a cam type change lever 108 which is used to rotate the frame 107. FIG. 7 shows a state of the moving means for thin paper in which the pressing load of the tension roller 106 against the belt 4 is set small and the tensile force of the belt 4 is set low. FIG. 8 shows a state of the moving means for thick paper in which the pressing load of the tension roller 106 against the belt 4 is set large and the tensile force of the belt 4 is set high.

Figure 9:
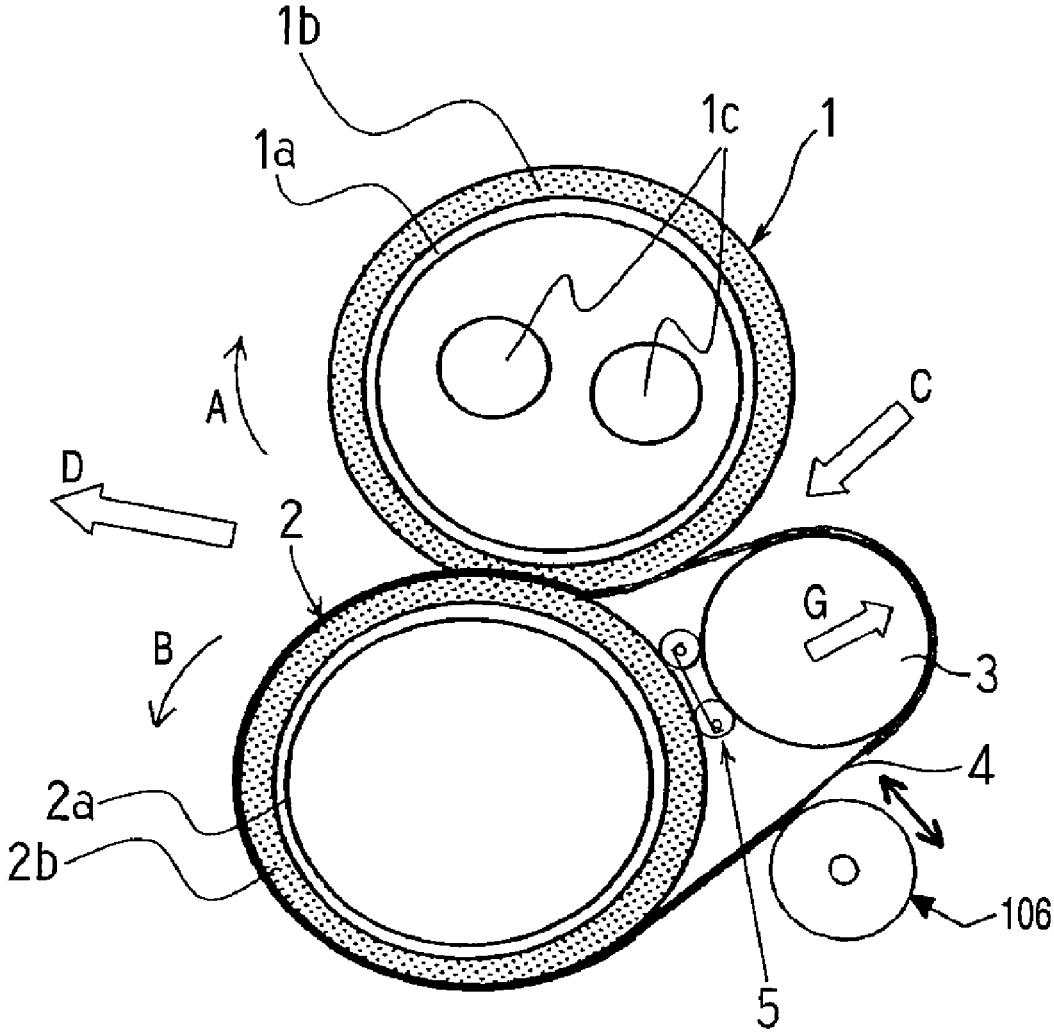
FIG. 9 is an explanatory view of a fourth embodiment of a fixing device according to the invention.

FIG. 9 shows a fourth embodiment of a fixing device according to the invention. The present embodiment differs from the embodiment shown in FIG. 6 in that a flexure preventing member 5 is interposed between the pressurizing roller 2 and belt extension member 3. When the belt 4 is mounted onto the pressurizing roller 2 and belt extension member 3 with a given tensile force, sometimes, the belt extension member 3 can be flexed due to the tensile force. In view of this, generally, as the belt extension member 3, there is employed a metal roller having a diameter which does not allow the metal roller to flex so much, and a tensile force is applied in the two end portions of the metal roller. However, when there is employed a metal roller having such diameter, the heat capacity thereof increases, the warm-up time thereof increases, and the responsibility thereof to the temperature control is lowered. Also, use of such metal roller increases the size of the fixing device and the heat radiation amount thereof, which makes it difficult to save energy. Further, when the belt extension member is formed of a metal roller having a small diameter or formed of a resin-made roller, the belt extension member can be flexed due to the belt tensile force, so that, when paper enters from the belt extension member side, an image formed on the paper can be out of focus in the central portion of the paper in the width direction thereof.

When, between the pressurizing roller 2 and belt extension member 3, there is arranged the flexure preventing member 5 in the central portion of the axial direction of the belt extension member 3, the flexure of the belt extension member 3 due to the belt tensile force can be prevented, and the belt extension member 3 can be formed of a resin-made member having a small diameter, thereby being able to reduce the size of the fixing device. Thus, the belt extension member 3 can be flexed in the central portion thereof. That is, when the flexure preventing member 5 is disposed in the central portion of the belt extension member 3 in such a manner that it is in contact with the pressurizing roller 2 and belt extension member 3, the warm-up time can be shortened.

Figure 10:
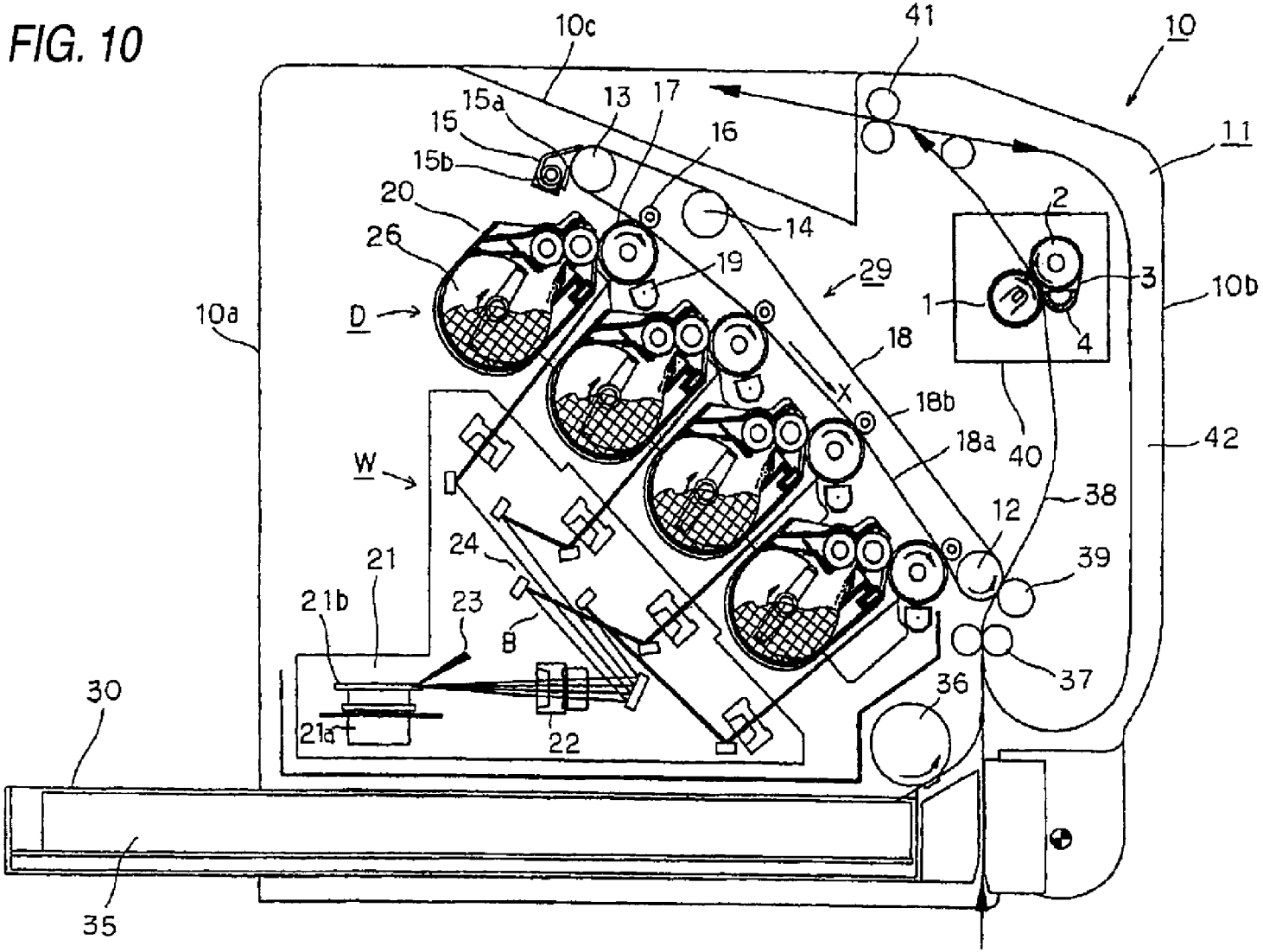
FIG. 10 is an explanatory view of an embodiment of an image forming apparatus according to the invention.

Now, FIG. 10 is a typical section view of the whole structure of an embodiment of an image forming apparatus according to the invention. In FIG. 10, reference character 10 designates an image forming apparatus, 10*a* a housing, 10*b* a door body, 11 a paper delivery unit, 15 cleaning means, 17 an image carrier, 18 image transfer delivery means, 20 developing means, 21 scanner means, 30 a paper feed unit, 40 fixing means, W an exposure unit, and D an image forming unit, respectively. And, the fixing means 40 is composed of the heating roller 1, pressurizing roller 2 and belt extension member 3 which cooperate together in constituting the above-mentioned fixing device according to the invention.

The image forming apparatus 10 according to the present embodiment comprises a housing 10*a*, a paper discharge tray 10*c* arranged in the upper portion of the housing 10*a*, and a door body 10*b* mounted on the front surface of the housing 10*a* in such a manner that it can be freely opened and closed; in the housing 10*a*, there are disposed an exposure unit (exposure means) W, an image forming unit D, a transfer belt unit 29 including image transfer delivery means 18, and a paper feed unit 30; and, in the door body 10*b*, there is provided a paper delivery unit 11. The respective units can be mounted on and removed from their associated major parts in which they are disposed and thus, in the maintenance thereof, they can be removed integrally with their major parts for repair and replacement.

The image forming unit D includes image forming stations Y (for yellow), M (for magenta), C (for cyan) and K (for black) for forming images of two or more (in the present embodiment, four) different colors. And, each of the image forming stations Y, M, C and K includes an image carrier 17 formed of a photosensitive drum, charging means 19 arranged on the periphery of the image carrier 17 and formed of corona charging means, and developing means 20. These image forming stations Y, M, C and K are arranged parallel to each other below the transfer belt unit 29 along an obliquely arch-shaped line in such a manner that the image carriers 17 face upward. By the way, the sequence of arrangement of the image forming stations Y, M, C and K can be set arbitrarily.

The transfer belt unit 29 comprises a drive roller 12 arranged in the lower portion of the housing 10*a* and rotatably drivable by a drive source (not shown), a driven roller 13 arranged obliquely upward of the drive roller 12, a tension roller 14, image transfer delivery means 18 formed of an intermediate transfer belt extended on and between at least two of these three rollers and circulatably drivable in the arrow mark (in FIG. 10) direction, and cleaning means 15 which can be contacted with the surface of the image transfer delivery means 18. The driven roller 13, tension roller 14 and image transfer delivery means 18 are arranged in a direction where they are inclined leftward in FIG. 10 with respect to the drive roller 12, whereby the belt surface 18*a* of the image transfer delivery means 18 the belt delivery direction of which is downward when the image transfer delivery means 18 is driven is situated downward, whereas the belt surface 18*b* the belt delivery direction of which is upward is situated upward.

Therefore, the image forming stations Y, M, C and K are also arranged in a direction where they are inclined leftward in FIG. 10 with respect to the drive roller 12. And, the image carrier 17 is brought into contact with the delivery-direction downward facing belt surface 18*a* of the image transfer delivery means 18 along the arc-shaped line and, as shown by the arrow mark shown in FIG. 10, is then driven and rotated in the delivery direction of the image transfer delivery means 18. In the case of the image transfer delivery means 18 which is formed like a flexible endless sleeve, in order to bring it into contact with the image carrier 17 at the substantially same winding angle in such a manner that it covers the image carrier 17 from above, the contact pressure and nip width between the image carrier 17 and image transfer delivery means 18 can be adjusted by controlling the tensile force to be applied to the image transfer delivery means 18 by the tension roller 14, the arrangement intervals of the image carriers 17, the winding angle (the curvature of the arc) and the like.

The drive roller 12 serves also as a backup roller for a secondary transfer roller 39. On the peripheral surface of the drive roller 12, there is formed a rubber layer which, for example, has a thickness of 3 mm or so and a volume resistivity of $10^2\Omega\cdot$cm or less and thus, when the drive roller 12 is grounded through a metal-made shaft, it provides a conduction path for a secondary transfer bias to be supplied through the secondary transfer roller 39. When a high-friction and impact-absorbing rubber layer is provided on the drive roller 12 in this manner, an impact occurring when a transfer member enters a secondary transfer portion is hard to be transmitted to the image transfer delivery means 18, which can prevent the deteriorated image quality. Also, when the diameter of the drive roller 12 is set smaller than the diameters of the driven roller 13 and backup roller 14, after completion of the secondary transfer of the transfer member, the transfer member is easy to peel off by its own elastic force. Further, the driven roller 13 is also used as a backup roller for the cleaning means 15 which will be discussed later.

By the way, the image transfer delivery means 18 may also be disposed in a direction where it is inclined rightward in FIG. 10 with respect to the drive roller 12 and, correspondingly to this, the respective image forming stations Y, M, C and K may also be arranged along in an obliquely arc-shaped line which is inclined rightward in FIG. 10 with respect to the drive roller 12: that is, they may also be arranged in a symmetrical manner with respect to the arrangement shown in FIG. 10.

As material for the image transfer delivery means, preferably, there may be used PC resin, PET resin, polyimide resin, urethane resin, silicone resin, polyether resin, polyester resin or the like. Of course, in order to set the conductivity, rigidity and the like of the image transfer delivery means for their desired values, or, the surface roughness, friction coefficient and the like of the image transfer delivery means for their desired values, there may also be added an additive which properly corresponds to the above-mentioned resin. Also, referring further to the rigidity of the image transfer delivery means, desired rigidity can also be set by setting the thickness of the image transfer delivery means.

In the present embodiment, the image transfer delivery means is formed of polyurethane resin and polyether resin which are relatively low in rigidity and are free from permanent distortion or creep; and, using the energizing force of the roller, the tensile force is set for 40N and the winding angle of the image carrier is set for 4°, whereby the contact pressure to be applied to the nip portion is set for about 2.8 N (=40 N×sin 4°), which provides a stable transfer condition. However, our experiment has confirmed the following fact: that is, with the above-mentioned material taken into consideration, when, using the energizing force of the roller, the tensile force is set for 10 N-100 N, the winding angle of the image carrier is set for 0.5°-15°, and the set values of these two factors are properly combined together, a desired transfer condition can also be set.

A primary transfer member 16 is disposed at a position where it can be contacted with the inside of the image transfer delivery means, as transfer bias apply means which transfers toner images sequentially and superimposingly to thereby form an image. Owing to the above-mentioned application of the contact pressure, there is eliminated the need to apply a pressing force for forming a transfer nip portion. Since the primary transfer member 16 has only to be contacted with the image transfer delivery means as means which is capable of securing electric supply to the image transfer delivery means, the primary transfer member 16 can be made of, for example, a conductive roller or a rigid contact member which can be contacted with the image transfer delivery means and can be rotated following the image transfer delivery means, or a conductive elastic member such as a plate spring, or a conductive brush formed of fiber groups such as resin. Therefore, the primary transfer member 16 has small sliding resistance with respect to the image transfer delivery means. This not only can improve their mutual lives but also makes it possible to produce the primary transfer member 16 at low costs.

As has been described above, in the image forming apparatus according to the present embodiment, there is employed a structure in which two or more image carriers 17 are arranged in parallel, the endless sleeve-shaped flexible image transfer delivery means 18 is arranged in contact with the respective image carriers 17 while is has substantially the same winding angle to them, the image transfer delivery means 18 is extended on and over at least two rollers 12 and 13 and is then driven and rotated, and the tensile force is applied to the image transfer delivery means 18 using any one of the rollers 12 and 13 to thereby transfer the toner images of the image carriers 17 sequentially and superimposingly. With use of this structure, according to the substantially same winding angles, in the contact portions of the image carriers 17 and image transfer delivery means 18, there can be easily formed substantially the same nip portions and the contact pressures of the contact portions can be set substantially the same.

On the other hand, in the image carriers 17 and image transfer delivery means 18 which is driven in contact with the image carriers 17, the moving circumferential speeds of the contact portions of these two pars may be preferably coincident with each other. However, in the mass production of them, actually, it is not practical to set the circumferential speeds of the image carriers 17 and image transfer delivery means 18 completely equal to each other due to the following variations: that is, the image carriers 17 can vary in the outside diameters and centers thereof, the drive means for driving the image carriers 17 can vary in the center thereof, the drive roller 12 for the image transfer delivery means 18 can vary in the diameter thereof, or the drive means for driving the image transfer delivery means 18 can vary in the center thereof.

With these variations taken into consideration, the moving speed of the image transfer delivery means 18 with respect to the moving speed of the image carrier 17 varies, that is, gets relatively faster or slower, which is not preferable in setting various transfer conditions. Rather, preferably, the relative speed of them may have a relative speed difference which is shifted to one of the faster and slower sides with respect to the image carrier 17. However, if the relative speed difference is set for an extremely large value, when the toner images to be delivered by the image carriers 17 are transferred to the image transfer delivery means 18, the toner images are different in position from each other so that the formed image is out of focus. Therefore, preferably, the relative speed difference maybe set as small as possible.

When the above-generated speed difference is set for a relative speed difference which is shifted to either of the faster or slower side with respect to the two or more image carriers 17, if the production capacity and the limit of the image distortion in the mass production are taken into consideration, preferably, the speed difference, that is, the moving speed of the image transfer delivery means 18 with respect to the moving speed of the image carrier 17 may have a difference of ±(direction) 3±(variation) 2% or so.

Also, when the moving speed of the image carrier 17 is equal to that of the image transfer delivery means 18, the toner images are transferred by the electrical energy action of the transfer bias. On the other hand, when there is set the above-mentioned speed difference between them, a mechanical scraping action is added to the electrical energy action to thereby be able to enhance the transfer efficiency. Therefore, the step of cleaning the remaining toner after transfer can be omitted or simplified.

Further, when there is set a relative speed difference between the moving speed of the image carrier 17 and the moving speed of the image transfer delivery means 18, unfavorably, the image transfer delivery means 18, which is flexible, is loosened between the drive roller 12 and itself or between the contact nip portions thereof with respect to the image carriers 17. In view of this, when the speed of the image transfer delivery means 18 with respect to the image carriers 17 is shifted to the faster side, the drive roller 12 of the image transfer delivery means 18 may be disposed on the downstream side of the image transfer delivery means 18. And, when the speed of the image transfer delivery means 18 with respect to the image carriers 17 is shifted to the slower side, the drive roller 12 of the image transfer delivery means 18 may be disposed on the upstream side thereof. This can prevent the occurrence of the above-mentioned loosening of the image transfer delivery means 18 and thus a preferable transfer condition can be set.

The cleaning means 15, which is disposed on the delivery-direction downward facing belt surface 18*a* side, includes a cleaning blade 15*a* for removing the toner remaining on the surface of the image transfer delivery means 18 after the secondary transfer and a toner delivery member 15*b* for delivering the toner collected. The cleaning blade 15*a* is in contact with the image transfer delivery means 18 in the winding portion of the image transfer delivery means 18 onto the driven roller 13. Also, with the back surface of the image transfer delivery means 18, there is contacted the primary transfer member 16 in such a manner that it faces the image carriers 17 of the respective image forming stations Y, M, C and K which will be discussed later; and, to the primary transfer member 16, there is applied the transfer bias.

The exposure means W is disposed in a space formed obliquely downward of the image forming unit D which is arranged in an oblique direction. Also, in the bottom portion of the housing 10*a* that is disposed below the exposure means W, there is arranged the paper feed unit 30. The whole of the exposure means W is stored within a case, while the case is disposed in a space formed obliquely downward of the delivery-direction downward facing belt surface. In the bottom portion of the case, there is horizontally arranged single scanner means 21 which is composed of a polygon mirror motor 21*a* and a polygon mirror (rotary poly-surface mirror) 21*b*. And, on an optical system B which reflects laser beams (which are emitted from two or more laser beam sources 23 and are modulated by the respective color image signals) by the polygon mirror 21*b* and bias scans these laser beams on the respective image carriers 17, there are disposed a single f-θ lens 22 and two or more reflecting mirrors 24 by which the scanning optical paths of the respective colors can be returned to the image carriers 17 not parallel to each other.

In the above-structured exposure means W, image signals respectively corresponding to their associated colors are emitted from the polygon mirror 21*b* in the form of laser beams modulated and formed according to the frequencies of a common data clock, and are radiated through the f-θ lens 22 and reflecting mirrors 24 onto the image carriers 17 of the respective image forming stations Y, M, C and K, so that latent images are formed. The provision of the reflection mirrors 24 makes it possible to bend the scan optical paths and decrease the height of the case, with the result that the optical system can be made compact. Also, the reflecting mirrors 24 are arranged in such a manner that the lengths of the scan optical paths to the image carriers 17 of the respective image forming stations Y, M, C and K are equal to each other. When the lengths of the optical paths (optical path lengths) to the image carriers 17 from the polygon mirror 21*b* of the exposure means W with respect to the respective image forming units D are set substantially equal to each other in this manner, the scan widths of the optical beams scanned by the respective optical paths are also substantially the same, which can eliminate the need for provision of a special structure for forming the image signals. Therefore, although the laser beams are respectively modulated by different image signals correspondingly to the images of different colors, they can be modulated and formed according to the frequencies of a common data clock; and also, because of use of the common reflecting surface, the distorted colors possibly caused by the relative difference in the sub scanning direction can be prevented. This makes it possible to structure a color image forming apparatus which is simple in structure and is inexpensive.

Also, in the present embodiment, since the scanning optical system is disposed in the lower portion of the image forming apparatus, the vibrations of the scanning optical system due to vibrations applied by the drive system of the image forming means to the frame supporting the apparatus can be controlled to a minimum, thereby being able to prevent the deteriorated image quality. Especially, by arranging the scanner means 21 in the bottom portion of the case, the vibrations applied to the whole of the case by the polygon motor 21*a* itself can be minimized to thereby prevent the deteriorated image quality. Also, by reducing the number of the polygon motors 21*a* or the vibration producing sources to one, the vibrations applied to the whole of the case can be minimized.

The paper feed unit 30 includes a paper feed cassette 35 with transfer members laminated and held therein, and a pickup roller 36 for feeding the transfer members one by one from the paper feed cassette 35. The paper delivery unit 11 includes a pair of gate rollers 37 (one of which is disposed on the housing 10*a* side) for regulating the paper feed timing of the transfer members to the secondary transfer portion, a secondary transfer roller 39 serving as secondary transfer means to be pressed against the drive roller 12 and image transfer delivery means 18, a main recording medium delivery passage 38, fixing means 40, a pair of paper discharge rollers 41, and a double-side printing delivery passage 42.

Secondary images (unfixed toner images), which are secondarily transferred to the transfer member, are fixed at a given temperature in the nip portion formed by the fixing means. In the present embodiment, the fixing means 40 can be disposed in a space formed obliquely upward of the delivery-direction upward facing belt surface 18*b* of the transfer belt, in other words, a space formed on the opposite side to the image forming stations with respect to the transfer belt, which makes it possible to reduce the transmission of heat to the exposure means W, image transfer delivery means 18 and image forming means, thereby being able to decrease the frequency of execution of a correcting operation for correcting the respective distorted colors. Especially, because the exposure means W is situated at a position most distant from the fixing means 40, the displacement of the exposure means W due to the heat of the parts of the scanning optical system can be restricted to a minimum, which makes it possible to prevent the distortion of the colors.

In the present embodiment, since the image transfer delivery means 18 is disposed in a direction where it is inclined with respect to the drive roller 12, in FIG. 10, there is produced a wide space on the right side and the fixing means 40 can be arranged in such space. This not only can realize a compact fixing device but also heat generated in the fixing means 40 can be prevented from being transmitted to the exposure unit W arranged on the left side, image transfer delivery means 18 and image forming stations Y, M, C and K. Also, because the exposure unit W can be disposed in a space existing in the left lower portion of the image forming unit D, the vibrations of the scanning optical system of the exposure unit W, which are caused by vibrations applied to the housing 10*a* by the drive system of the image forming means, can be reduced to a minimum, thereby being able to prevent the image quality from being deteriorated.

Also, in the present embodiment, the primary transfer efficiency is enhanced (substantially 100%) by using spherical toners, whereby, in the respective image carriers 17, there is arranged no cleaning means which is used to collect the toners remaining after the primary transfer. Thanks to this, the respective image carriers 17, each of which is formed of a photosensitive drum having a diameter of 30 mm or less, can be disposed adjacent to each other, thereby being able to reduce the size of the fixing device.

Further, since no cleaning means is used, as charging means, there is employed the corona charging means 19. When a roller is used as the charging means, the remaining toners after the primary transfer existing on the image carriers 17 are accumulated on the roller, though the quantities of the toners are very small, resulting in poor charging. On the other hand, in the case of the corona charging means 19 which is non-contact charging means, the toners are hard to stick to it, thereby being able to prevent the occurrence of the poor charging.

Moreover, in the above-mentioned embodiments, there is employed the structure in which the intermediate transfer belt is used as the image transfer delivery means 18 and it is brought into contact with the image carriers 17. However, according to the invention, there may be employed another structure in which, as the image transfer delivery means 18, there is used a transfer member delivery belt, which attracts a transfer member onto the surface thereof and delivers the transfer member while moving, transfers toner images onto the surface of the transfer member sequentially and superimposingly to thereby form and deliver an image on the transfer member; and, such transfer member delivery belt is brought into contact with the image carriers 17. This structure is different from the above-mentioned respective embodiments in that the belt delivery direction of the transfer member delivery belt used as the image transfer delivery means 18 goes upward on the lower surface side thereof to be contacted with the image carriers 17, reversely to the direction of the respective embodiments.

The summary of the operation of the whole image forming apparatus having the above-mentioned structure is as follows:

(1) When a printing instruction signal (image forming signal) from a host computer (not shown) or the like (a personal computer or the like) is input into the control unit of the image forming apparatus, the image carriers 17 of the respective image forming stations Y, M, C, K, the respective rollers of the developing means 20, and image transfer delivery means 18 are respectively driven and rotated.

(2) The outer peripheral surfaces of the image carriers 17 are electrically charged uniformly by the charging means 19.

(3) To the outer peripheral surfaces of the image carriers 17 which are uniformly charged in the respective image forming stations Y, M, C and K, there is applied exposure selectively according to the image information of the respective colors by the exposure unit W, thereby forming electrostatic latent images for the respective colors.

(4) The electrostatic latent images formed in the respective image carriers 17 are developed by the developing means 20 into toner images.

(5) A primary transfer voltage having a polarity opposite to the charged polarity of the toner is applied to the primary transfer member 16 of the image transfer delivery means 18 and, as the image transfer delivery means 18 moves, in the primary transfer portion, the toner images formed on the image carriers 17 are transferred sequentially onto the image transfer delivery means 18 in such a manner that the toner images are superimposed on top of each other.

(6) Simultaneously with the movement of the image transfer delivery means 18 on which the primary images have been primarily transferred, the transfer member stored in the paper feed cassette 35 is fed through the pair of registration rollers 37 to the secondary transfer roller 39.

(7) The primary transfer images join the transfer member simultaneously in the secondary transfer portion, and a bias voltage having a polarity opposite to the primary transfer images is applied to the primary transfer images by the secondary transfer roller 39 which is pressed toward the drive roller 12 of the image transfer delivery means 18 by a pressure mechanism (not shown), so that the primary transfer images are secondarily transferred to the transfer member that is fed simultaneously with the primary transfer images.

(8) The remaining toners after secondary transfer are delivered in the direction of the driven roller 13 and are scraped by the cleaning means 15 disposed opposite the driven roller 13, thereby refreshing the image transfer delivery means 18, so that the above-mentioned cycle can be repeated again.

(9) When the transfer member passes through the fixing means 40, the toner images on the transfer member are fixed and, after then, the transfer member is delivered toward a given position (that is, unless the printing is the double-side printing, toward the discharge tray 10*c;* and, for the double-side printing, toward the double-side printing delivery passage 42).

Description has been given heretofore of the embodiments of the invention. However, the invention is not limited to these embodiments but conventionally known or well known technologies can also be substituted or added.

What is claimed is:

1. A fixing device comprising:

a heating roller;

a pressurizing roller, pressed against the heating roller;

a belt extension member, arranged on an upstream side of a medium delivery direction with respect to the pressurizing roller;

a belt, wound around outer peripheries of the pressurizing roller and the belt extension member, and moving while forming a fixing nip portion between the heating roller and the belt; and a member, moving the belt extension member rotationally to vary a winding amount of the belt around the heating roller, wherein the member includes a support frame supporting the pressurizing belt and the belt extension member, and the support frame rotates about a center shaft of the pressurizing roller.

2. The fixing device according to claim 1, wherein the member further includes an elastic member biasing the support frame in an opposite direction to the heating roller.

3. The fixing device according to claim 2, wherein the member further includes a lever moving the support frame toward the heating roller.

4. The fixing device according to claim 1, wherein an amount of rotation of the belt extension member is varied based on the kind of paper.

5. The fixing device according to claim 1, wherein a rotation and positioning of the belt extension member are set depending on a rotation and positioning of the support frame.

6. The fixing device according to claim 1, further comprising a flexure preventing member interposed between the pressurizing roller and belt extension member.

7. An image forming apparatus comprising the fixing device according to claim 1.

* * * * *